US006152685A

United States Patent [19]

Hagi

[11] Patent Number: 6,152,685

[45] Date of Patent: Nov. 28, 2000

[54] SEAL ACTIVE CLEARANCE CONTROL SYSTEM FOR GAS TURBINE STATIONARY BLADE

[75] Inventor: Naoki Hagi, Takasago, Japan

[73] Assignee: Mitsubishi Heavy Industries, Ltd., Tokyo, Japan

[21] Appl. No.: 09/250,605

[22] Filed: Feb. 17, 1999

[51] Int. Cl.[7] ..... F01D 11/14

[52] U.S. Cl. ..... 415/14; 415/116; 415/118; 415/127; 415/173.2; 415/175

[58] Field of Search ..... 415/14, 115, 116, 415/118, 127, 128, 173.1, 173.7, 173.2, 174.1, 175, 230

[56] References Cited

U.S. PATENT DOCUMENTS

| | | | |
|---|---|---|---|
| 4,326,804 | 4/1982 | Mossey | 356/375 |
| 4,329,114 | 5/1982 | Johnston et al. | 415/145 |
| 4,338,061 | 7/1982 | Beitler et al. . | |
| 4,363,599 | 12/1982 | Cline et al. | 415/136 |
| 4,513,567 | 4/1985 | Deveau et al. . | |
| 4,842,477 | 6/1989 | Stowell | 415/118 |
| 5,056,988 | 10/1991 | Corsmeier et al. | 415/173.2 |
| 5,468,123 | 11/1995 | Guimier et al. . | |
| 5,601,402 | 2/1997 | Wakeman et al. | 415/173.2 |

FOREIGN PATENT DOCUMENTS 2-153232 6/1990 Japan .

*Primary Examiner*—Edward K. Look
*Assistant Examiner*—Liam McDowell
*Attorney, Agent, or Firm*—Wenderoth, Lind & Ponack, L.L.P.

[57] ABSTRACT

A clearance control system for a turbine seal optimizes a clearance by controlling the change in the clearance during a run due to a thermal elongation by cooling the sealing air. The air from a compressor is cooled by a cooler 12 and is guided via an outer shroud 22 and a tube 28 in a stationary blade 21 into a cavity 26 in an inner shroud 23. The air flows through a space 34 from a seal portion 36 to the outside and through a seal ring 25 and a space 35 from a seal portion 37 to the outside to seal the inner side of the inner shroud 23 from a hot combustion gas. A clearance δH between a stationary portion and a rotary portion changes due to a thermal elongation. A clearance measuring sensor 14 monitors the clearance δH without intermission. When the clearance δH is large, the control unit 10 opens the flow regulator valve 11 to cause the air to bypass the cooler 12. When the clearance δH is small, the control unit 10 closes the valve 11 to control the thermal elongation so that the clearance δH may be optimized at all times. As a result, the sealing performance can be improved to avoid the contact.

1 Claim, 3 Drawing Sheets

SEAL ACTIVE CLEARANCE CONTROL SYSTEM FOR GAS TURBINE STATIONARY BLADE

BACKGROUND OF THE INVENTION

The present invention relates to a seal active clearance control system for a gas turbine stationary blade.

In a stationary blade of a gas turbine, the air of a compressor is partially bled from an outer shroud and guided through the inside of the stationary blade into a cavity of an inner shroud to make the pressure in the cavity higher than that of an outside hot combustion gas to thereby prevent the entrance of the hot gas into the inside.

FIG. 3 is a section showing a general sealing structure for the gas turbine stationary blade. In FIG. 3, a stationary blade 21 includes an outer shroud 22 and an inner shroud 23. This inner shroud 23 supports a seal ring retaining ring 24 at its flange, and a seal ring 25 is supported by the seal ring retaining ring 24 to seal discs 33*a* and 33*b* on the rotor side. A cavity 26 is formed by the seal ring retaining ring 24 and the inner shroud 23. Numeral 27 designates a hole formed in the seal ring retaining ring 24, and a sealing air tube 28 is formed through the stationary blade from the outer shroud 22 to the inner shroud 23.

Moving blades 31*a* and 31*b* are arranged adjacent to each other across the stationary blade 21 with respect to the longitudinal direction of the rotor axis, and have platforms 32*a* and 32*b*. Spaces 34 and 35 are formed in the stationary blade 21 between the moving blades 31*a* and 31*b*. Seal portions 36 and 37 at the two ends of the inner shroud 23 individually seal the platforms 32*a* and 32*b* of the moving blades and the two end portions of the inner shroud 23 of the stationary blade 21.

In the stationary blade thus constructed, a portion of bleed air of a compressor (that is, the sealing air 40) is guided from the compartment to the outer shroud 22 and flows through the sealing tube 28 in the stationary blade 21 and further into the cavity 26, as indicated by arrow 40*a*. A portion of the air having flown into the cavity 26 flows through the hole 27 of the seal ring retaining ring 24 into the front space 34, as indicated by arrow 40*b*, and further through the seal portion 36 into a combustion gas passage, as indicated by arrow 40*c*. Moreover, the sealing air passes the seal portion of the seal ring 25 and flows into the rear space 35, as indicated by arrow 40*d*, until it finally flows out from the rear seal portion 37 to the combustion gas passage, as indicated by arrow 40*e*.

Due to the sealing air 40 described above, the pressure in the cavity 26 formed in the inner shroud 23 and in the two spaces 34 and 35 is made higher than that in the combustion gas passage to prevent the hot combustion gas from entering the inside of the inner shroud 23.

On the other hand, a clearance δH has to be maintained between the confronting faces of the seal ring 25 of the stationary portion and the rotor discs 33*a* and 33*b* of the rotary portion. An excessively large clearance δH increases the leakage of air and lowers the sealing performance, and an excessively small clearance δH causes the stationary side and the rotary side to contact each other. Thus, it is necessary to set a proper clearance.

On the inner side of the stationary blade of the gas turbine, as described above, there is mounted the seal ring 25 to keep the clearance δH at the face confronting the rotor disc portion of the rotary portion. This clearance δH may increase the leakage, if excessively large, so as to affect the sealing performance adversely, and may also cause, if excessively small, the stationary portion and the rotary portion to contact each other.

This clearance δH is extended or contracted due to the influences of thermal elongation of the rotary portion and the stationary portion in the running state of the gas turbine during, for example, a starting time or a loaded running time. This thermal elongation is slightly different between the stationary portion and the rotary portion, but the clearance δH has to be set so that no contact may occur between the two portions at the minimum clearance during the run. Usually, the clearance δH is set with an allowance to keep the portions from contacting even when it is minimized at an assembly time. However, this clearance has to be set as small as possible, while sufficient for avoiding the contact. At present, however, there is no means for controlling the clearance properly, and it has been earnestly desired to realize such means.

SUMMARY OF THE INVENTION

It is, therefore, an object of the invention to provide a seal clearance active control system which optimizes the clearance between the stationary portion and the rotary portion of a gas turbine at all times by detecting the change in the clearance due to a thermal elongation at all times. The thermal elongation is controlled by the temperature of the sealing air so as to reduce the clearance, if the clearance becomes excessively large, and so as to enlarge the clearance if it becomes excessively small.

In order to achieve this object, according to the invention, there is provided the following means.

A seal active clearance control system for a gas turbine stationary blade comprises: a sensor fixed on a gas turbine stationary blade seal ring portion, so as to confront a rotor disc face, for measuring a clearance between the confronting faces; a cooler disposed in a sealing air feed line, through which the air from a compressor is guided through the inside of the stationary blade into a cavity in the stationary blade, for cooling the air; a flow regulator valve disposed in a bypass passage in parallel with the cooler; and a control unit for controlling the flow regulator valve.

The control unit receives a signal of the clearance from the sensor for opening the flow regulator valve when the signal is higher than a preset value, and for closing the flow regulator valve when the signal is lower than the preset value.

In the invention, the clearance between the stationary portion and the rotary portion is always monitored by the control unit through the measurement of the sensor so that a signal is detected by the sensor. When the clearance is changed by the thermal elongation at the starting time or at the loaded running time of the gas turbine, that data is inputted to the control unit. This control unit is preset with an optimum clearance value and opens the flow regulator valve when the input signal of the sensor is higher than the set value. Thus, a portion of the air from the compressor bypasses the cooler, and is guided into the cavity so that the temperature of the sealing air is raised to enlarge the thermal elongation of the stationary portion so as to reduce the clearance.

When the input signal of the sensor is lower than the set value, the stationary portion and the rotary portion might contact each other. Therefore, the control unit closes the flow regulator valve to cool the entire flow of air with the cooler so that the temperature of the sealing air is lowered to reduce the thermal elongation of the stationary portion, thereby enlarging the clearance. When the signal of the sensor is at the set value, the flow regulator valve is set to keep its prevailing degree of opening.

Thus, the control unit monitors the clearance at all times so that the clearance may be optimized. As a result, the clearance is kept at the optimum value so that the air leakage can be reduced to improve the sealing performance, and so that contact between the stationary portion and the rotary portion can be prevented to ensure a safety run.

DESCRIPTION OF THE PREFERRED EMBODIMENT

Figure 1:
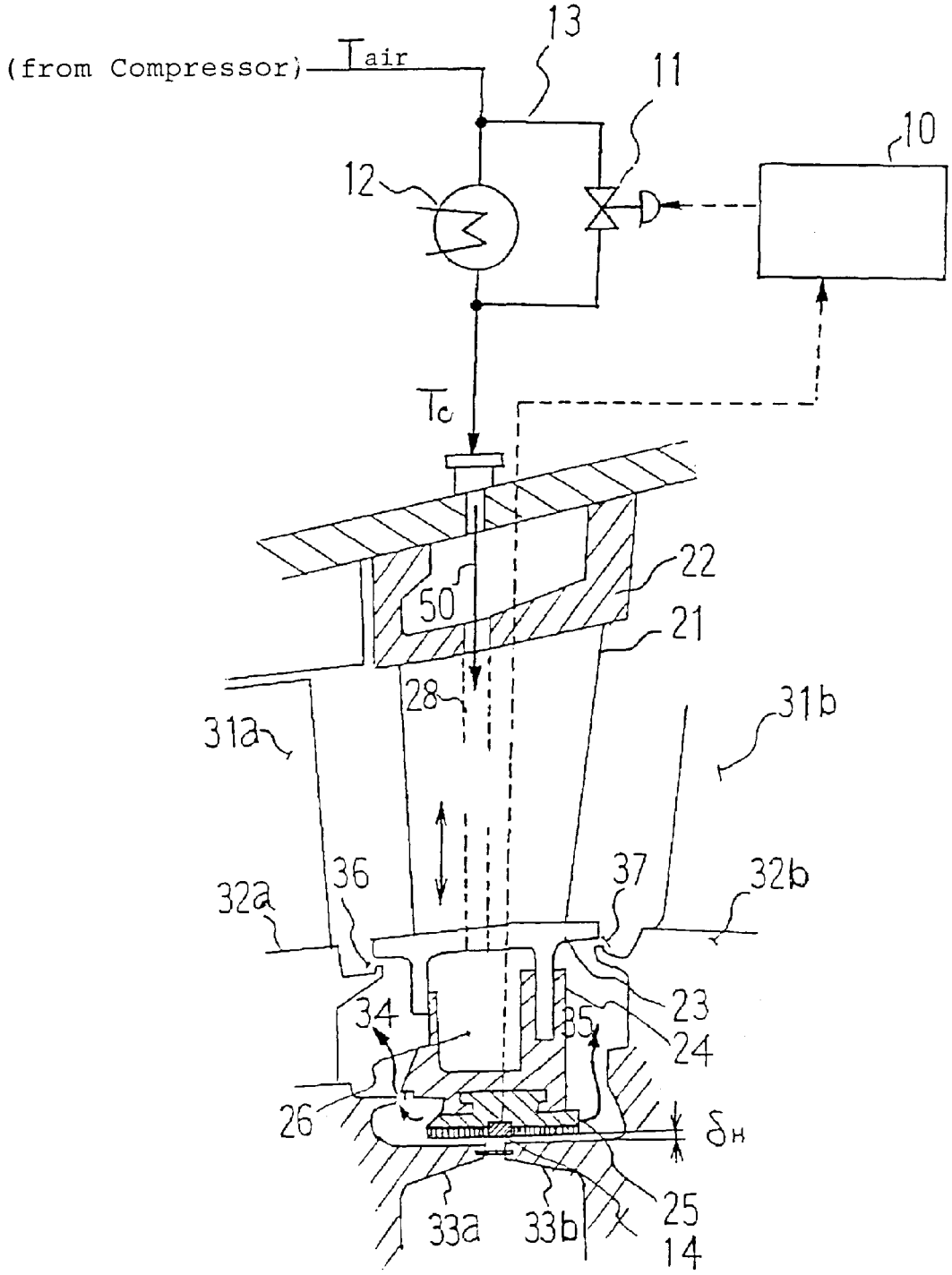
FIG. 1 is a diagram of a construction of a seal clearance active control system for a gas turbine stationary blade according to one embodiment of the invention.
Figure 3:
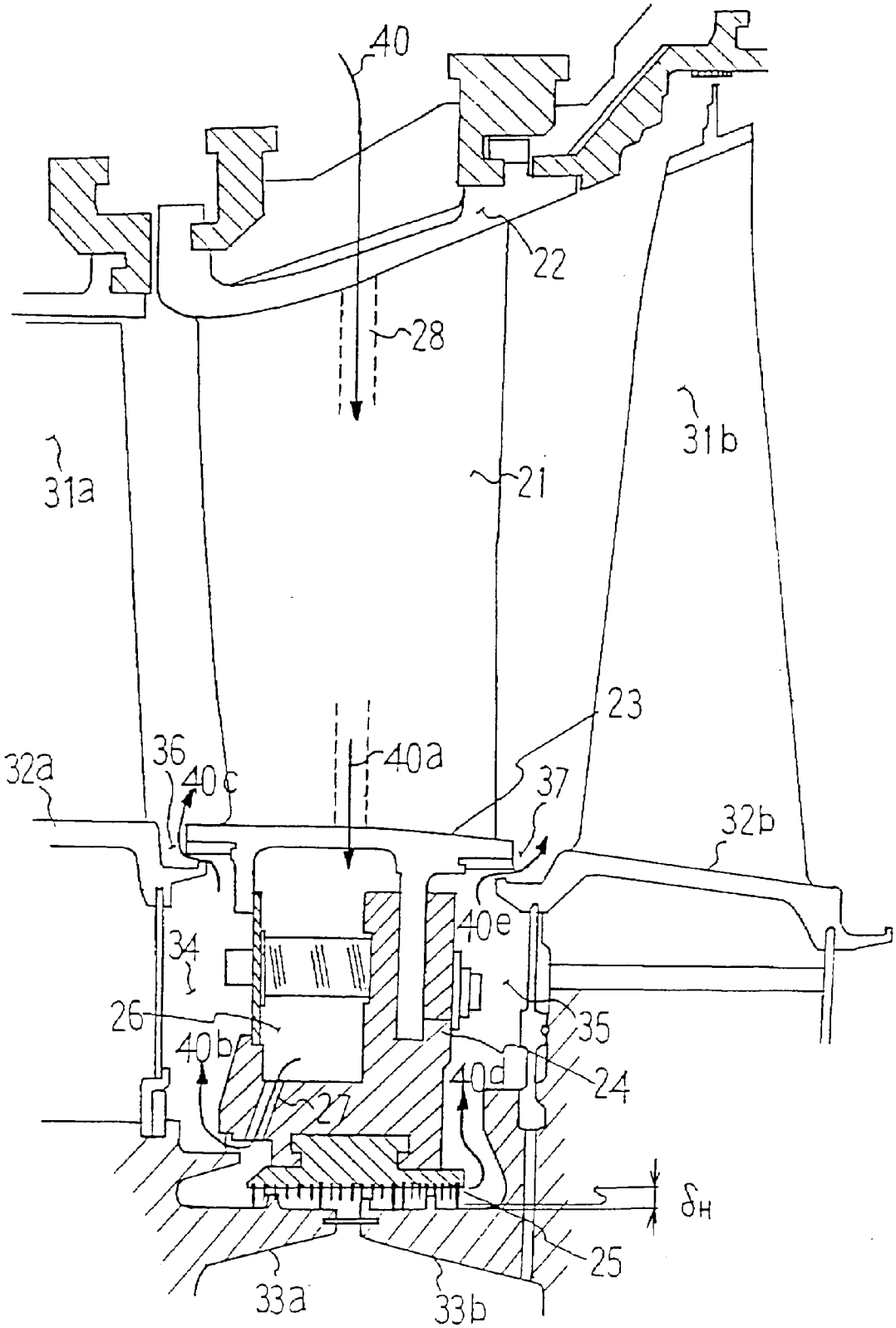
FIG. 3 is a general section of a sealing structure of the stationary blade of the gas turbine.

An embodiment of the invention will be specifically described with reference to the accompanying drawings. FIG. 1 is a diagram of a construction of a seal clearance active control system for a gas turbine stationary blade according to one embodiment of the invention. As shown, a stationary blade 21 has an outer shroud 22 and an inner shroud 23. The inner shroud 23 retains a seal ring retaining ring 24 at its flange. This seal ring retaining ring 24 supports a seal ring 25, and a cavity 26 is formed by the seal ring 25 and the inner shroud 23. A clearance δH is held between the confronting faces of the seal ring 25 and rotor discs 33*a* and 33*b*. This construction is identical to that of the prior art described with reference to FIG. 3.

Numeral 10 designates a control unit, numeral 11 designates a flow regulator valve for regulating the flow of air to bypass it, and numeral 12 designates a cooler for cooling sealing air. This cooler 12 is provided in the sealing air line at the gas turbine having an entrance gas temperature of 1,500° C., but is newly added to the gas turbine having no permanent cooler. Numeral 13 designates a bypass passage, and numeral 14 designates a clearance measuring sensor which is mounted and fixed on the gas turbine stationary blade seal ring 25 so as to confront the rotor disc face.

In the sealing air line, the air is bled from the compressor and guided through the cooler 12. The sealing air 50 is guided into a compartment and further from the outer shroud 22 through the inside of the stationary blade 21 so that it is guided into the cavity 26 from a sealing air tube 28 formed through the inner shroud 23. The sealing air from this cavity 26 flows (as in the prior art) through the holes (not-shown) of the seal ring retaining ring 24 into a space 34, as indicated by an arrow, and flows out into a seal portion 36. Likewise, the sealing air having passed the seal ring 25 reaches an air chamber 35 and flows out into a seal portion 37. Thus, the stationary blade 21 is constructed to prevent the inflow of hot combustion gas by sealing the inside of the inner shroud 23 from the hot combustion gas.

The bypass passage 13 guides a portion of the air so as to bypass the cooler 12 when the flow regulator valve 11 disposed therein is opened. This passage 13 is controlled by the control unit 10 which opens and closes the flow regulator valve 11.

In the system thus constructed, the clearance δH is monitored at all times by the clearance measuring sensor 14, and its signal is inputted to the control unit 10. The sealing air is bled from the compressor and is cooled through the cooler 12, and the sealing air 50 is guided from the sealing tube 28 into the cavity 26. The temperature $T_{air}$ of the air from the compressor is at about 200 to 300° C. a gas turbine having an entrance gas temperature of 1,300° C., and the sealing air is cooled to about Tc=150 to 200° C. by the cooler and is fed as the sealing air 50.

In the control unit 10, the signal from the clearance measuring sensor 14 is monitored and is compared with a preset optimum clearance value. If the clearance is excessively large, the flow regulator valve 11 is opened in order to mix a portion of the air from the compressor into the cooling air while bypassing the cooler 12. Therefore, the temperature of the cooling air is raised to enlarge the thermal elongations of the seal ring retaining ring 24 and the seal ring 25 to thereby narrow the clearance.

If the clearance is excessively small, on the other hand, contact with the rotor disc side might occur. Therefore, the flow regulator valve 11 is closed in order to reduce the amount of bypassed air so that the temperature of the sealing air is lowered in order to reduce the thermal elongations of the seal ring retaining ring 24 and the seal ring 25 to thereby enlarge the clearance. When the signal of the sensor is at the set value, the flow regulator valve is set to keep the prevailing degree of opening.

Figure 2:
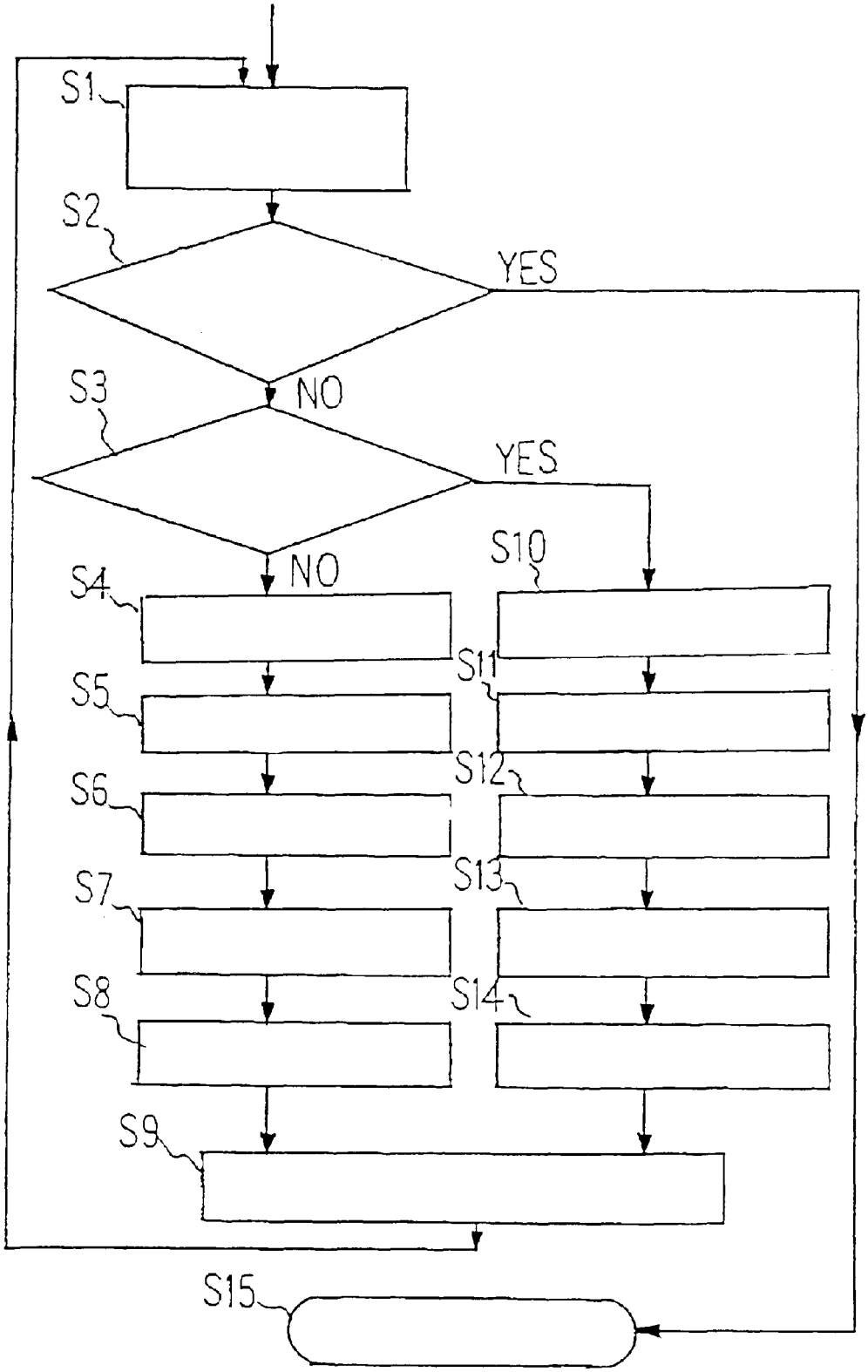
FIG. 2 is a control flow chart of the seal clearance active control system for the gas turbine stationary blade according to the embodiment of the invention.

FIG. 2 is a flow chart showing the situations of the controls thus far described. As shown, the signal from the clearance measuring sensor 14 is monitored at S1 by the control unit 10. At S2, it is determined whether or not the measured clearance is at the preset optimum value present in the control unit 10. If an equal result is obtained, it is decided at S15 that the clearance is optimum, and the prevailing degree of opening of the flow regulator valve is maintained.

If it is decided at S2 that the clearance is not equal to the set value, it is determined at S3 whether or not the clearance is larger than the set value. If this answer is NO, it is decided at S4 that the measured clearance is smaller. At S5, the flow regulator valve 11 is closed. At S6, the cooling air temperature Tc is lowered. At S7, the thermal elongation of the seal ring retaining ring 24 or the like on the stationary side is reduced. At S8, the clearance δH is enlarged. At S9, it is decided that the clearance has changed.

Then, the routine returns to S1, at which the signal of the clearance measuring sensor 14 is monitored.

If it is decided at S3 that the measured value of the clearance measuring sensor 14 is larger than the set value, it is decided at S10 that the measured clearance is large. At S11, the flow regulator valve 11 is opened. At S12, the cooling air temperature Tc is raised. At S13 the thermal elongation of the seal ring retaining ring 24 on the stationary side is increased. At S14, it is decided that the clearance 14 has been reduced. Then, the routine advances to S9 and returns again to S1, at which the signal of the clearance measuring sensor 14 is monitored.

Here, the first embodiment has been described in the example in which the flow regulator valve 11 is opened/closed. However, the opening of the flow regulator valve 11 may naturally be adjusted according to the magnitude of the clearance to thereby decide the flow rate of the bypass passage 13.

On the other hand, the clearance control system thus far described may naturally be attached to each of multiple stationary blades which are constructed at multiple stages, or only to the stationary blade at a necessary stage.

According to the seal clearance active control system for the gas turbine stationary blade of the embodiment thus far described, the signal of the clearance measuring sensor 14, as mounted on the seal ring retaining ring 24 on the stationary side, is monitored at all times by the control unit 10. The control unit controls the temperature of the sealing air 50 to be cooled by the cooler 12 to thereby adjust the thermal elongation of retaining ring 24 and seal ring 25 so that the clearance δH may be maintained at the optimum value. As a result, the clearance on the stationary side and the rotary side is always kept optimum to improve the sealing performance and to prevent the contact trouble.

What is claimed is:

1. A seal clearance control apparatus for a gas turbine stationary blade, comprising:

a sensor to be mounted on a gas turbine stationary blade seal ring so as to confront a rotor disc face, said sensor being adapted to measure a clearance between a face of the gas turbine stationary blade seal ring and the rotor disc face, and to generate a clearance signal based on the measured clearance;

a sealing feed air line for conveying air from a compressor through the gas turbine stationary blade and into a cavity in the gas turbine stationary blade, said sealing feed air line including a cooling passage portion and a bypass passage portion;

a cooler disposed in said cooling passage portion of said sealing feed air line so as to cool the air conveyed through said cooling passage portion of said sealing feed air line;

a flow regulator valve disposed in said bypass passage portion of said sealing feed air line, said bypass passage portion of said sealing feed air line being arranged parallel to said cooling passage portion of said sealing feed air line so as to form a bypass around said cooler; and a control unit for receiving said clearance signal from said sensor and for controlling said flow regulator valve based on said clearance signal, wherein said control unit opens said flow regulator valve when said clearance signal is greater than a preset clearance value, and wherein said control unit closes said flow regulator valve when said clearance signal is less than said preset clearance value.

* * * * *